US005632478A

United States Patent [19]

Quesnel et al.

[11] Patent Number: 5,632,478

[45] Date of Patent: May 27, 1997

[54] CAM IDLER FOR DESKEW OF LONG SHEETS AND BUCKLE LENGTH LATITUDE

[75] Inventors: Lisbeth S. Quesnel, Pittsford; Frank C. Darling, Jr., Wolcott, both of N.Y.

[73] Assignee: Xerox Corporation, Stamford, Conn.

[21] Appl. No.: 415,797

[22] Filed: Apr. 3, 1995

[51] Int. Cl.[6] ..... B65H 9/04

[52] U.S. Cl. ..... 271/242

[58] Field of Search ..... 271/242, 274, 271/10.12, 119

[56] References Cited

U.S. PATENT DOCUMENTS

| | | | |
|---|---|---|---|
| 4,361,399 | 11/1982 | Sawada et al. | 271/242 |
| 4,523,832 | 6/1985 | Strutt et al. | 355/3 |
| 4,529,188 | 7/1985 | Sturnick | 271/16.72 |
| 4,621,802 | 11/1986 | Ishida et al. | 271/242 |
| 4,685,664 | 8/1987 | Petersdorf | 271/242 |
| 5,022,642 | 6/1991 | Hasegawa et al. | 271/242 |
| 5,078,384 | 1/1992 | Moore | 271/228 |
| 5,083,766 | 1/1992 | Osawa | 271/242 |
| 5,085,420 | 2/1992 | Sata | 271/242 |
| 5,156,391 | 10/1992 | Roller | 271/227 |
| 5,163,674 | 11/1992 | Parks | 271/274 |
| 5,246,224 | 9/1993 | Matsuno et al. | 271/242 |
| 5,253,862 | 10/1993 | Acquaviva et al. | 271/251 |
| 5,355,206 | 10/1994 | Maruyama et al. | 271/242 |

FOREIGN PATENT DOCUMENTS

| | | | |
|---|---|---|---|
| 57-175643 | 10/1982 | Japan . | |
| 0144335 | 6/1990 | Japan | 201/242 |

OTHER PUBLICATIONS

Xerox Disclosure Journal, vol. 10, No. 1 Jan./Feb. 1985, p. 17 Inventor: Schoppe, et al.

*Primary Examiner*—William E. Terrell
*Assistant Examiner*—T. Kelly
*Attorney, Agent, or Firm*—Kevin R. Kepner

[57] ABSTRACT

A sheet aligning and registration device for a printing machine. In a stalled roll registration device there is provided a drive mechanism preceding the stalled roll which allows a sheet to move while within the drive nip. The drive mechanism uses a drive roll and an eccentric idler roll in contact therewith. The idler is biased against the drive roll by a compression spring such that as the eccentric idler roll rotates, the spring is alternately compressed and relaxed. When a sheet is driven through the drive mechanism and into the stalled nip, a buckle is formed which causes a force to be exerted on the drive nip which causes the eccentric roll to stall in the horizontal position in which little normal force is exerted on the sheet. The sheet is then free to deskew and align in the stalled nip. Once the sheet is aligned and deskewed, the stalled nip is actuated and the sheet is forwarded to a process station. When the sheet clears the eccentric drive nip the friction of the elastomeric drive roll against the eccentric idler causes the idler to rotate and drive the next sheet.

10 Claims, 3 Drawing Sheets

CAM IDLER FOR DESKEW OF LONG SHEETS AND BUCKLE LENGTH LATITUDE

This invention relates generally to a sheet registration device, and more particularly concerns a stalled nip registration feeder having a self relieving drive nip which allows the sheet to slip while being driven forward so as to properly register in the stalled nip.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, it is necessary to align and register the individual cut sheets so that the developed image is placed in the proper location on the sheet. Various schemes have been developed to assure that the image receiving sheet is in the proper location and forwarded at the proper time. Some complex printing machines utilize various sensors and translating nips to align the sheet in the proper position for receiving the image. Other machines utilize variable speed stepping motors to differentially drive a sheet within a sheet path for deskew and registration purposes. Both of these registration methods require sophisticated control and are relatively high cost.

Another method for registering and aligning a sheet is the use of stalled rolls. In the stalled roll technique, a sheet is driven into a nip in which the rolls are stopped causing a buckle to be formed between the stalled roll and the driving rolls. The force of the buckle causes the lead edge of the sheet to align itself within the stalled nip and the stalled nip is then activated so that the sheet is forwarded in the proper aligned position. One problem with stalled rolls is that when a longer sheet is forwarded through the stalled nip, the rear trailing edge of the sheet is still skewed within the previous drive nip. This can sometimes cause twist and skewing of the trail portion of the sheet due to the action of the previous drive nip on the trail edge of the sheet. Some schemes have utilized solenoid actuated nips so that once the stalled roll is actuated and the sheet is forwarded through the stalled nip the previous drive nip is deactivated by a solenoid so that the sheet is free to slip and straighten within that nip.

While simpler than the active registration systems described previously, the stalled roll technique with solenoid actuated nip still requires a solenoid to deactivate the drive nip preceding the stalled roll so that the sheet is free to deskew in the stalled nip. It is desirable to have a stalled roll registration device in which a long sheet could be deskewed and registered within the stalled nip without the necessity of having a solenoid actuated drive nip previous to the stalled nip. It is further advantageous to have a stalled roll registration device in which a long sheet can be forwarded to the stalled nip, have a buckle form, and have the previous drive nip slip to allow the sheet to deskew as the stalled nip is actuated. The following disclosures may be relevant to various aspects of the present invention.

U.S. Pat. No. -A-5,253,862
Patentee: Acquaviva, et al
Issue Date: October 19, 1993
U.S. Pat. No. -A-5,156,391
Patentee: Roller
Issue Date: October 20, 1992
U.S. Pat. No. -A-5,078,384
Patentee: Moore
Issue Date: January 7,1992
U.S. Pat. No. -A-4,523,832
Patentee: Strutt, et al
Issue Date: June 18, 1985
JP-57-175643
Patentee: Eisaku Saiki
Issue Date: October 28, 1982
Xerox Disclosure Journal
Vol. 10, No. 1
January/February, 1985, Pg. 17
Inventor: Schoppe, et al The relevant portion of the foregoing disclosures may be briefly summarized as follows:

U.S. Pat. No. 5,253,862 discloses a sheet handler including an idler and driven cross roller set. The rollers are preloaded so that a normal force exists between the rollers at the nip. The nip is provided with an apparatus for adjusting the preloaded force to adjust the normal force on the sheet material passing through the nip.

U.S. Pat. No. 5,156,391 describes an apparatus and method to deskew sheets in the short paper path by differentially driving two sets of rolls so as to create a paper buckle buffer zone in the sheet and then differentially driving a roll set to correct skew while the sheet is still within the nips of multiple drive roll sets.

U.S. Pat. No. 5,078,384 discloses a method and apparatus for deskewing and registering a sheet, including the use of two or more selectably controllable drive rolls operating in conjunction with sheet skew and lead edge sensors for frictionally driving and deskewing sheets having variable lengths. Sheets will be advanced to reach a predetermined registration position at a predetermined velocity and time at which time the sheets will no longer be frictionally engaged by the drive rolls.

U.S. Pat. No. 4,523,832 describes a sheet transport, including an outer curve guide surface input, either intermediate and output drive rolls, spaced apart less than the length of the drive sheet. The disengageable output drive nip cooperates with an opposed guide surface and one or more retractable stops to achieve registration of the copy sheet with the image.

JP-57-175643 describes a stalled roll technique of deskewing whereby the leading edge of a sheet is fed into the bite point of a set of stationary rollers causing the sheet to be deformed into a line by means of force supplied by a paper buckle along the stationary rolls, at which time the rolls are activated and the sheet is driven to the next station or set of rolls.

Xerox Disclosure Journal, Vol. 10, No. 1, Pg. 17, describes a single revolution electromagnetic friction clutch having feed rollers which are segmented rather than traditional full circumference feed rolls or wheels. The segmented feed rolls are utilized to forward a sheet until a predetermined sensor is actuated at which time the roll is engaged and the segmented portion disengages from the sheet, allowing the sheet to be forwarded by a secondary drive nip.

In accordance with one aspect of the present invention, there is provided an apparatus for registering a sheet in a path. The apparatus comprises a registration nip located in the path, a drive nip for transporting a sheet, preceding said registration nip in the path, said drive nip being configured so that a normal force applied to a driven sheet in said drive nip varies as the sheet is driven through said drive nip.

Pursuant to another aspect of the present invention, there is provided a printing machine in which a sheet is driven along a path and fed in a timed relationship and registration position to a process station. The printing machine comprises a registration nip located in the path and a drive nip for transporting a sheet, preceding said registration nip in the path, said drive nip being configured so that a normal force applied to a driven sheet in said drive nip varies as the sheet is driven through said drive nip.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
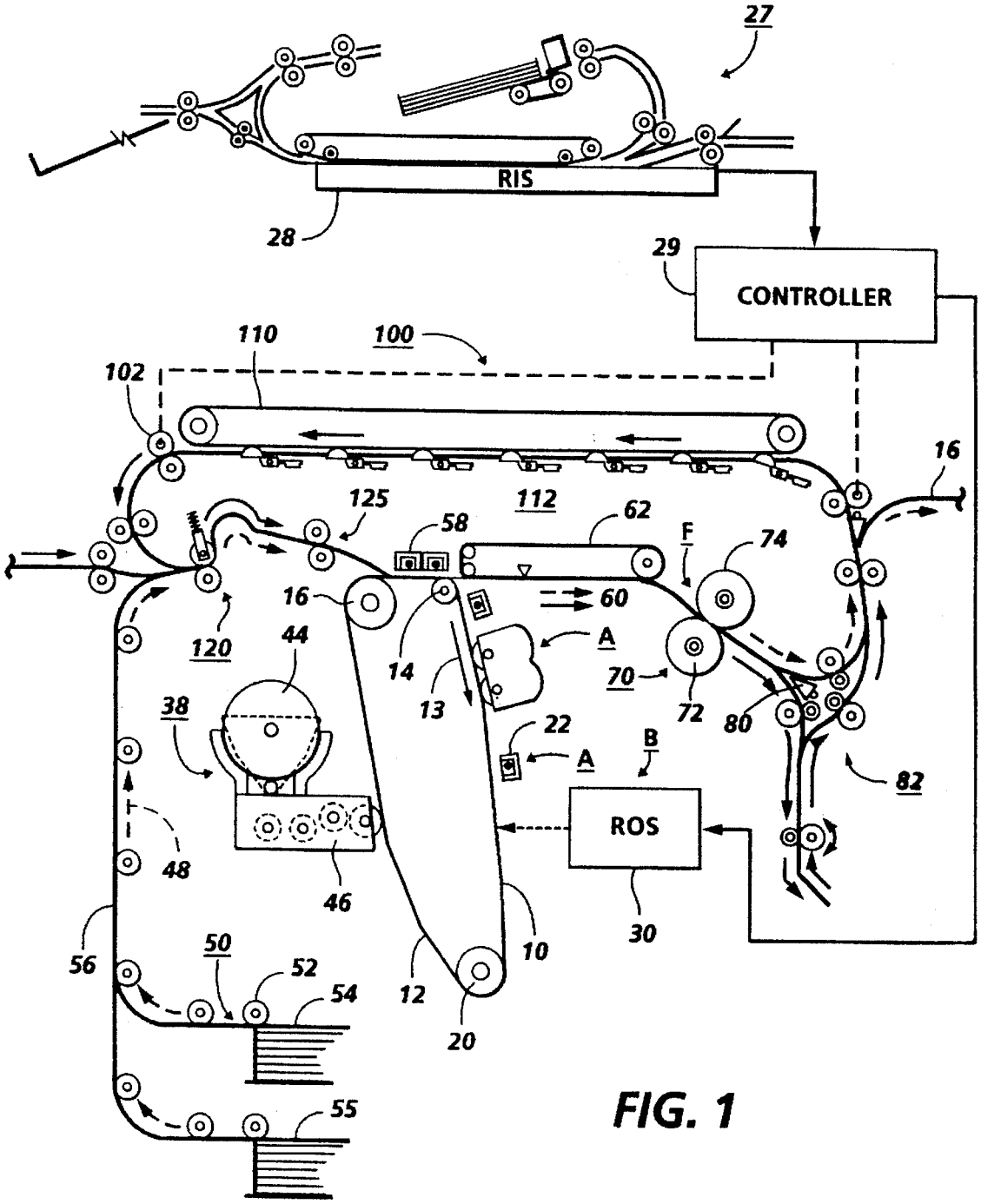
FIG. 1 is a schematic elevational view of a typical electrophotographic printing machine utilizing the sheet deskew and registration device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the stalled roll registration device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 125 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 16. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 16.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2A:
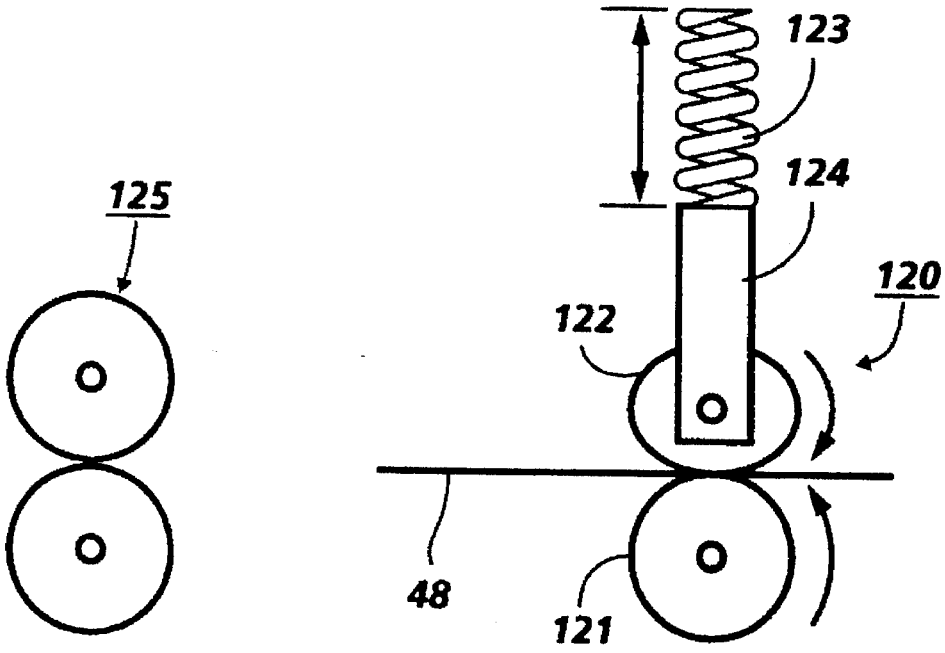
FIGS. 2A and 2B are detailed elevational views of the sheet registration and deskewing device of the present invention in the relaxed and compressed positions, respectively.
Figure 2B:
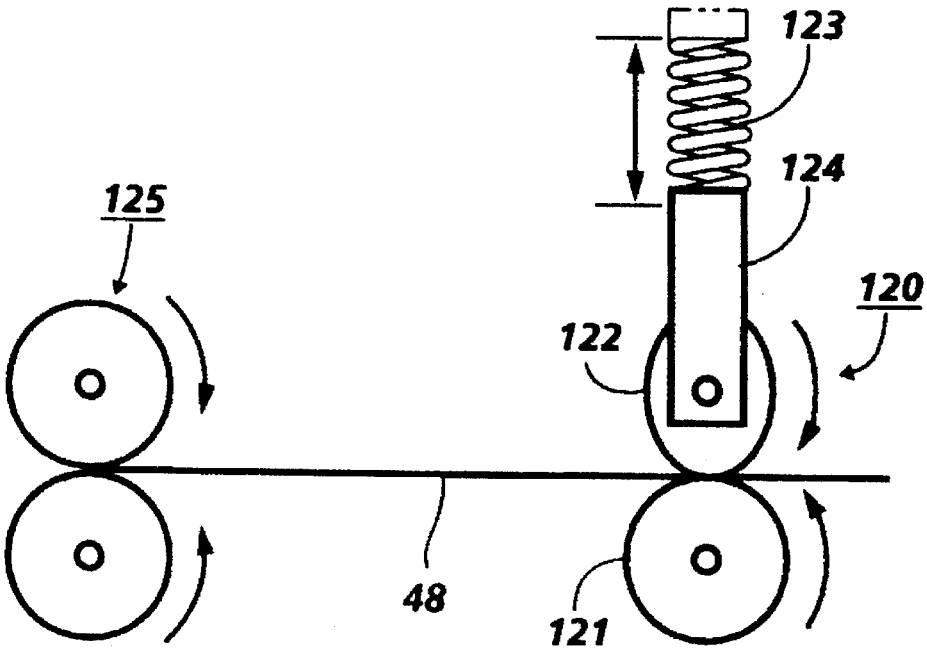

Turning now to FIGS. 2A and 2B, there is illustrated a detailed elevational view of the sheet registering and deskewing device of the present invention. The stalled roll registration pair 125 is shown with the lead edge of a sheet 48 entering therein. Prior to the stalled registration pair 125 is a drive roll 121 and eccentric idler 122 utilized in the registration and deskewing device of the present invention. The idler 122 is eccentric and is urged against the drive roll 121 by a compression spring 123, mounted to urge the support bracket and axle assembly 124 of the idler 122 toward the drive roll 121. As the idler 122 rotates, the eccentricity causes the compression spring 123 to be either in a compressed position (FIG. 2B) or a relaxed position (FIG. 2A). The relaxed position corresponds to the wide portion of the idler 122 being in a horizontal position and the compressed position corresponds to the wide portion of the idler 122 being in the vertical position as illustrated. When the wide portion of the idler is in the horizontal position (FIG. 2A), there is essentially no normal force exerted on the idler 122 by the compression spring 123 and the normal force in the nip is provided solely by the weight of the idler 122. Drive roll 121 rotates continuously and idler 122 is caused to rotate by frictional forces with the elastomer coating of the drive roll 121. As a sheet 48 enters the nip, the frictional forces continue to cause the idler 122 to rotate with the sheet 48 and the drive roll 121. As the sheet 48 is forwarded into the stalled nip 125, a buckle 49 (FIG. 3B) is formed.

Figure 3A:
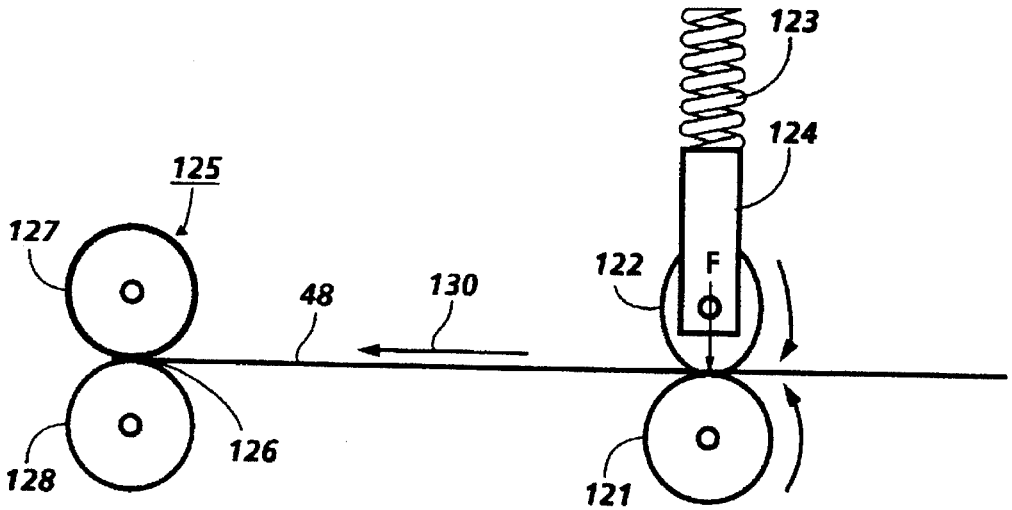
FIGS. 3A, 3B, and 3C is an elevational view of the sheet registering and deskewing device of the present invention illustrating the deskew cycle for a sheet being handled by the device.
Figure 3B:
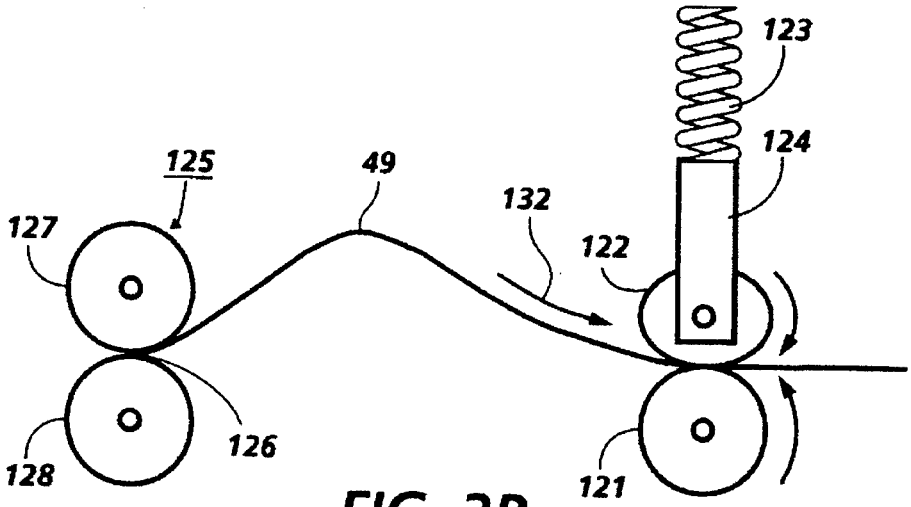
Figure 3C:
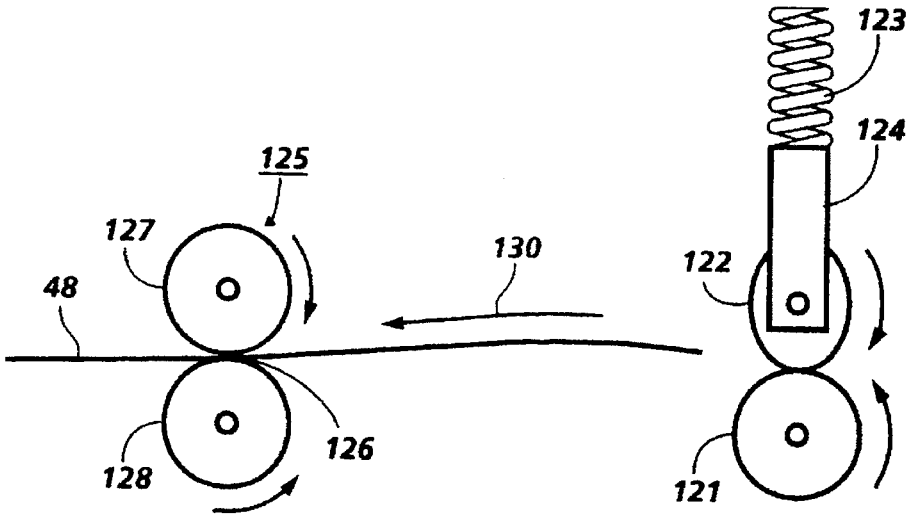

With reference now to FIGS. 3A to 3C, the deskew cycle utilizing the present device including the eccentric idler roll 122 will be described. As shown in FIG. 3A, as a sheet 48 passes through the drive nip formed by the drive roll 121 and the eccentric idler 122, it is forwarded to the stalled roll pair 125 and the nip thereof 126, and a buckle 49 begins to form. As the buckle 49 increases in size, a force illustrated by the reference arrow 132, is exerted by the sheet 48 against the idler roll 122 and causes the idler roll 122 to stall with the wide portion of the idler in the horizontal position, which, as a result of the low normal force applied by the spring 123 due to the decompression thereof, allows the sheet 48 to both rotate and slip backwards to deskew and register in the stalled nip 126. As the sheet 48 is forced into and aligned with the stalled nip 126, the stalled roll pair 125 is then actuated and the sheet 48 is driven forward as illustrated in FIG. 3C, thereby slipping through the deskewing drive nip. Once the trail edge of the sheet 48 exits the deskewing drive nip, the frictional force of the elastomeric drive roll 121 against the idler roll 122 causes the idler roll 122 to once again begin to rotate, thereby causing a variable normal force due to the compression and decompression of the spring 123. The next sheet enters the deskewing drive roll and the same cycle is repeated as previously described. The deskewing and registering drive nip described herein allows a sheet to be forwarded to a stalled roll, registered against that roll, and allows the trail edge of the sheet to skip within the deskewing drive roll without the necessity of a solenoid actuated/deactuated drive nip. This device provides a very inexpensive and reliable system for stalled roll registration and deskewing, especially of longer sheets.

The above-described registration and deskewing device is applicable in any instance within a printing machine in which there is a need for timed alignment and registration of a sheet for forwarding to a process station. Thus, the device could be used within the printing machine to forward a copy sheet to the photoreceptor in a timed relation, or could also be used in a document handler for forwarding original sheets to be copied to a platen or scanner. It is also possible to use various biasing devices to provide the normal force in the drive nip. Garter springs, flexible spring tangs, elastomeric bands or any other known biasing devices can be used to provide the normal force.

While the invention herein has been described in the context of an image transfer sheet registration device, it will be readily apparent that the device can be utilized in any sheet feeding situation which requires individual sheets to be delivered in a timed relationship. Other such uses include side shifting or translating registration systems to relieve side forces on a sheet and to deplete a buckle which contains these uneven forces.

In recapitulation, there is provided a sheet aligning and registration device for a printing machine. In a stalled roll registration device there is provided a drive mechanism preceding the stalled roll which allows a sheet to move while within the drive nip. The drive mechanism uses a drive roll and an eccentric idler roll in contact therewith. The idler is biased against the drive roll by a compression spring such that as the eccentric idler roll rotates, the spring is alternately compressed and relaxed. When a sheet is driven through the drive mechanism and into the stalled nip, a buckle is formed which causes a force to be exerted on the drive nip which causes the eccentric roll to stall in the horizontal position in which little normal force is exerted on the sheet. It is at this time that the sheet is free to slip in the drive nip and align in the stalled nip so that it is forwarded in the proper alignment. The sheet is then free to deskew and align in the stalled nip. Once the sheet is aligned and deskewed, the stalled nip is actuated and the sheet is forwarded to a process station. When the sheet clears the eccentric drive nip the friction of the elastomeric drive roll against the eccentric idler causes the idler to rotate and drive the next sheet.

It is, therefore, apparent that there has been provided in accordance with the present invention, a sheet registration and aligning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for registering a sheet in a path, comprising:

a registration nip located in the path;

a drive nip for transporting a sheet, preceding said registration nip in the path, said drive nip being configured so that a normal force applied to a driven sheet in said drive nip varies as the sheet is driven through said drive nip;

a drive member;

a nonuniform idler member, in contact with said drive member to form a nip therebetween; and a biasing device, cooperating with said nonuniform idler member so that the normal force in the drive nip varies as the sheet is driven through said drive nip.

2. An apparatus according to claim 1, wherein said drive member comprises a driven roll.

3. An apparatus for registering a sheet in a path, comprising:

a registration nip located in the path;

a drive nip for transporting a sheet, preceding said registration nip in the path, said drive nip being configured so that a normal force applied to a driven sheet in said drive nip varies as the sheet is driven through said drive nip wherein said drive nip comprises a drive member; a nonuniform idler member, in contact with said drive member to form a nip therebetween; and a biasing device, cooperating with said idler member so that the normal force in the drive nip varies as the sheet is driven through said drive nip wherein said idler member comprises an eccentric roll, in contact with said drive member.

4. An apparatus according to claim 3, wherein said biasing device comprises a compression spring in contact with said idler roll so that as said eccentric idler roll rotates due to frictional contact with said drive member said compression spring is compressed and relaxed causing the normal force in the drive nip to vary.

5. An apparatus according to claim 3, wherein said drive member comprises a driven roll.

6. A printing machine in which a sheet is driven along a path and fed in a timed relationship and registration position to a process station, comprising:

a registration nip located in the path;

a drive nip for transporting a sheet, preceding said registration nip in the path, said drive nip being configured so that a normal force applied to a driven sheet in said drive nip varies as the sheet moves through said drive nip;

a drive member;

a nonuniform idler member, in contact with said drive member to form a nip therebetween; and a biasing device, cooperating with said nonuniform idler member so that the normal force in the drive nip varies as the sheet is driven through said drive nip.

7. A printing machine according to claim 6, wherein said drive member comprises a driven roll.

8. A printing machine in which a sheet is driven along a path and fed in a timed relationship and registration position to a process station, comprising:

a registration nip located in the path;

a drive nip for transporting a sheet, preceding said registration nip in the path, said drive nip being configured so that a normal force applied to a driven sheet in said drive nip varies as the sheet moves through said drive nip, wherein said drive nip comprises a drive member; an idler member, in contact with said drive member to form a nip therebetween; and a biasing device, cooperating with said idler member so that the normal force in the drive nip varies as the sheet is driven through said drive nip, wherein said idler member comprises an eccentric roll, in contact with said drive member.

9. A printing machine according to claim 8, wherein said biasing device comprises a compression spring in contact with said idler roll so that as said eccentric idler roll rotates due to frictional contact with said drive member said compression spring is compressed and relaxed causing the normal force in the drive nip to vary.

10. A printing machine according to claim 9, wherein said drive member comprises a driven roll.

* * * * *